US009885968B2

(12) United States Patent
Kondo et al.

(10) Patent No.: US 9,885,968 B2
(45) Date of Patent: Feb. 6, 2018

(54) TONER

(71) Applicant: Sharp Kabushiki Kaisha, Sakai, Osaka (JP)

(72) Inventors: Yuya Kondo, Sakai (JP); Osamu Wada, Sakai (JP); Yoritaka Tsubaki, Sakai (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 15/299,866

(22) Filed: Oct. 21, 2016

(65) Prior Publication Data

US 2017/0115586 A1 Apr. 27, 2017

(30) Foreign Application Priority Data

Oct. 23, 2015 (JP) ..... 2015-208933

(51) Int. Cl.
*G03G 9/08* (2006.01)
*G03G 9/087* (2006.01)

(52) U.S. Cl.
CPC ..... *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08775; G03G 9/08782; G03G 9/08795; G03G 9/08797
USPC ..... 430/109.4, 108.8, 111.4
See application file for complete search history.

(56) References Cited

U.S. PATENT DOCUMENTS

2013/0011778 A1* 1/2013 Yamashita ..... G03G 9/0806 430/109.2

FOREIGN PATENT DOCUMENTS

JP 01-284862 A 11/1989

* cited by examiner

*Primary Examiner* — Mark A Chapman
(74) *Attorney, Agent, or Firm* — Keating & Bennett, LLP

(57) ABSTRACT

The toner including a crystalline polyester resin dispersed in an amorphous polyester resin obtained by polymerizing a bivalent alcohol component and a dicarboxylic component, the crystalline polyester resin containing a linear saturated aliphatic polyester unit and being dispersed by a monoester-based wax added as a detaching agent, wherein the crystalline polyester resin in the toner has a dispersion diameter of 100 nm or more and 500 nm or less, and the monoester-based wax has a dispersion diameter of 200 nm or more and 1,000 nm or less.

5 Claims, No Drawings

TONER

CROSS-REFERENCE TO RELATED APPLICATION

This application is related to Japanese Patent Application No. 2015-208933 filed on Oct. 23, 2015, whose priority is claimed under 35 USC § 119, and the disclosures of which are incorporated by reference in their entirety.

BACKGROUND OF THE INVENTION

1. Field of the Invention

The present invention relates to a toner.

2. Description of the Related Art

In recent years, development in office automation equipment has been experiencing remarkable growth, with the result that image forming apparatuses have been widely prevalent, such as copying machines, printers, and facsimile machines, which use an electrophotographic system.

Electrophotographic image forming apparatuses usually form an image through the following steps: charging electrically a surface of a rotary drive photoreceptor uniformly by use of a charger; exposing the charged photoreceptor surface to laser light emitted from an exposure device so as to form an electrostatic latent image on the photoreceptor surface; developing the electrostatic latent image on the photoreceptor surface by use of a developing device using a toner so as to form a toner image on the photoreceptor surface; transferring the toner image on the photoreceptor surface onto a transfer material (recording medium) by use of a transfer device; fixing the toner image by heating a fixing device so as to fix the toner image onto the transfer material.

In recent years, electrophotography has been advancing in full-color print; in line with that, improvement of toners has been taking place—for example, improvement of binder resins for dispersing a crystalline polyester resin therein so as to improve low-temperature fixability of the toner.

To obtain desirable chargeability, Japanese Unexamined Patent Application Publication No. Hei 1(1989)-284862 suggests carriers in which carrier cores are covered with a silicone resin containing an aminosilane coupling agent.

There were problems to be noticed: A toner was fused with a surface of a developing roller while being stirred in a two-component development apparatus for a prolonged time; a baking phenomenon occurred in which an entire surface of the developing roller was covered with toner components as time passed; and an image density decreased.

It was thought that when the toner components, such as a crystalline polyester and a wax, were exposed on the toner surface, these components—lower in softening point and melting point than an amorphous polyester resin and others—were more likely to fuse with the developing roller surface. It was also thought that the crystalline polyester resin and the monoester-based wax, which were exposed on the toner surface, exuded because of a compression force between the developing roller and a developer, localized friction heat, and rise in temperature inside the two-component development apparatus, resulting in the fusion of the toner components with the developing roller surface. As a result, it was thought that the fused crystalline polyester resin and wax induced the toner to adhere continuously to the developing roller and that the entire developing roller was eventually covered with the toner components.

BRIEF SUMMARY OF THE INVENTION

The present invention has an object of solving the follow-described problems: The toner fuses with the developing roller surface while being stirred in the two-component development apparatus for a prolonged time; the baking phenomenon occurs in which the entire surface of the developing roller is covered with the toner components as time passes; and the image density decreases.

The inventors of the present invention made intensive studies to solve the above-described problems in the following way and reached the completion of the present invention: A toner including a crystalline polyester resin containing a linear saturated aliphatic polyester unit is subjected to a dispersion treatment so as to be dispersed in an amorphous polyester resin by a monoester-based wax as a detaching agent, the amorphous polyester resin being obtained by polymerizing a bivalent alcohol component and a dicarboxylic acid-containing acid component monomer.

The present invention provides a toner including a crystalline polyester resin dispersed in an amorphous polyester resin obtained by polymerizing a bivalent alcohol component and a dicarboxylic component, the crystalline polyester resin containing a linear saturated aliphatic polyester unit and being dispersed by a monoester-based wax added as a detaching agent, wherein the crystalline polyester resin in the toner has a dispersion diameter of 100 nm or more and 500 nm or less, and the monoester-based wax has a dispersion diameter of 200 nm or more and 1,000 nm or less.

The present invention provides the toner wherein the crystalline polyester resin-to-the amorphous polyester resin in mass ratio is 5:95 to 50:50.

The present invention provides the toner wherein a difference in solubility parameter value (Δ SP value) between the crystalline polyester resin and the amorphous polyester resin is 1.4 to 2.2 $(cal/cm^3)^{1/2}$.

The present invention provides the toner wherein the crystalline polyester resin has a dispersion diameter of 100 nm or more to 300 nm or less, and the monoester-based wax has a dispersion diameter of 200 nm or more to 800 nm or less.

The present invention provides the toner wherein the monoester-based wax has a melting point of 68° C. or higher to lower than 75° C.

The toner in which the crystalline polyester resin containing the linear saturated aliphatic polyester unit is dispersed in the amorphous polyester resin obtained by polymerizing the bivalent alcohol component and the dicarboxylic component is good in dispersibility by using the main resin, and is capable of lowering the crystalline polyester resin and the monoester-based wax on the toner surface by use of the ester wax that is unlikely to be compatible with the crystalline resin, with the result that the toner is prevented from being baked on a developing roller.

The toner of the present invention is advantageous in the following respects: The toner does not fuse with the developing roller surface while being stirred in a two-component development apparatus for a prolonged time; the toner does not give rise to a baking phenomenon in which an entire surface of the developing roller is covered with the toner components as time passes; and the toner does not give rise to a decrease in image density, with the result that the toner is capable of stably providing clear images over a prolonged period.

The toner of the present invention allows the monoester-based waxes, and the crystalline polyester resin to have appropriate dispersibility, and is capable of preventing the toner components from fusing with the developing roller.

The toner of the present invention in which the crystalline polyester resin containing the linear saturated aliphatic polyester unit is dispersed in the amorphous polyester resin obtained by polymerizing the bivalent alcohol component and the dicarboxylic component is good in dispersibility by using the main resin, and is capable of lowering the crystalline polyester resin and the monoester-based wax on the toner surface by use of the ester wax that is unlikely to be compatible with the crystalline resin, with the result that the toner is prevented from being baked on the developing roller.

DETAILED DESCRIPTION OF THE INVENTION

Toner

In the following, a toner of the present invention will be explained in detail. The toner of the present invention contains a binder resin and an external additive, the binder resin containing an amorphous polyester resin and a crystalline polyester resin, wherein the amorphous polyester resin is obtained by polycondensation of a dicarboxylic monomer—such as terephthalic acid or isophthalic acid as a main component—and a diol monomer—such as ethylene glycol as a main component; wherein the crystalline polyester resin is obtained by polycondensation of a dicarboxylic monomer—such as an aliphatic dicarboxylic acid having 9 to 22 carbon atoms as a main component—and a diol monomer—such as an aliphatic diol having 2 to 10 carbon atoms as a main component; and wherein the external additive may be large-diameter silica microparticles whose primary particle diameter is 75 nm to 220 nm after these microparticles are hydrophobized.

The toner of the present invention comprises toner base particles and the external additive that is externally added to surfaces of the toner base particles, the toner base particles containing the binder resin; and the toner base particles generally contain any of the following internal additives: a detaching agent, colorants, a charge-controlling agent, and others. The toner of the present invention is preferably 5 μm to 10 μm in volume average particle diameter, and more preferably 5.5 μm to 7.5 μm. The toner is 105 to 120° C. in flow softening point.

Binder Resin

The binder resin to be used for the toner of the present invention contains at least the above-described amorphous polyester resin and crystalline polyester resin. The crystalline polyester resin and the internal additives, such as the detaching agent, the colorants, and the charge-controlling agent, are dispersed in the amorphous polyester resin.

Since the crystalline polyester resin is generally capable of decreasing a softening temperature and a melt viscosity of a toner, it is known that the crystalline polyester resin used with an amorphous polyester resin is capable of improving low-temperature fixability of the toner. In the binder resin to be used for the toner of the present invention, the dicarboxylic monomer contained as the main component in the amorphous polyester resin is different from the dicarboxylic monomer contained as the main component in the crystalline polyester resin—in some cases, the main component of the diol monomer of the amorphous polyester resin is different from the main component of the diol monomer of the crystalline polyester resin—and this makes compatibility of these polyester resins firmly suppressed, resulting in high enhancement of the low-temperature fixability. The suppressed compatibility of these polyester resins, however, causes the crystalline polyester resin to be readily released from the amorphous polyester resin and to be readily fixed on a developing roller together with the large-diameter silica. It is thus highly effective to use, as the external additive, the large-diameter silica microparticles whose primary particle diameter is 75 nm to 220 nm after these microparticles are hydrophobized.

The monomer used for the polyester may be any of those known as polyester dicarboxylic acids that are commonly used in the relevant technical field; and examples of the monomer include aromatic carboxylic acids such as terephthalic acid, isophthalic acid, phthalic anhydride, pyromellitic acid, and naphthalenedicarboxylic acid; aliphatic carboxylic acids such as maleic anhydride, fumaric acid, succinic acid, alkenyl anhydrous succinic acid, and adipic acid; and lower alkyl esters of these polybasic acids such as ester compounds including methyl, ethyl, n-propyl, i-propyl, and t-butyl.

The above-described dicarboxylic acids may be used independently, or two or more kinds may be used in combination.

In addition to the dicarboxylic acid, a tricarboxylic acid may be used, such as trimellitic acid or anhydrous trimellitic acid.

Used as the bivalent alcohol may be any of those known as monomers for polyester; and examples of the bivalent alcohol include aliphatic polyols such as ethylene glycol, propylene glycol, butanediol, hexanediol, neopentyl glycol, and glycerin; alicyclic polyols such as cyclohexanediol, cyclohexane dimethanol, and hydrogenated bisphenol A; and aromatic diols such as ethylene oxide adducts of bisphenol A and propylene oxide adducts of bisphenol A.

The bivalent alcohols may be used independently, or two or more kinds may be used in combination.

A polycondensation reaction of the dicarboxylic acid and the bivalent alcohol may be carried out in the usual manner; for example, the dicarboxylic acid and the bivalent alcohol may be polymerized in the presence of an organic solvent and a polycondensation catalyst.

The polymerization reaction may be stopped at a time when an acid value or a softening temperature of a polyester resin to be prepared reaches to a predetermined value.

This is how the polyester resin is obtained.

In some cases, the organic solvent may not necessarily used. In a case where a methyl esterified compound of dicarboxylic acid is used as a part of the dicarboxylic acid, de-methanol polycondensation reaction is carried out. If the dicarboxylic acid and the bivalent alcohol are properly changed in ratio and reaction rate during this polycondensation reaction, a content of the carboxyl group at end of the polyester may be adjusted, leading to changes in characteristics of the polyester.

It is preferable that the polycondensation of the bivalent alcohol component and the dicarboxylic component should be carried out in the presence of an esterification catalyst. Excellent examples of the esterification catalyst in the present invention include titanium compounds and inorganic tin (II) compounds; and these compounds may be used independently, or two respective compounds may be used in combination. The titanium compounds having a Ti—O bond are preferable; and those having an alkoxy group, an alkenyloxy group, or an acyloxy group with 1 to 28 carbon atoms in total are more preferable.

Used as the alkoxy group with 1 to 28 carbon atoms in total is, for example, a methoxy group, an ethoxy group, an isopropyl alkoxy group, a t-butyl alkoxy group, or a pentoxy group.

In the present invention, the main component of the dicarboxylic monomer indicates a monomer having a largest molar content rate among all monomers that form the dicarboxylic monomer; and the same applies to the main component of the diol monomer; and additionally, this includes cases where one monomer involves (namely, cases where a molar content rate of terephthalic acid, isophthalic acid, ethylene glycol, an aliphatic dicarboxylic acid having 9 to 22 carbon atoms, or an aliphatic diol having 2 to 10 carbon atoms is 100%).

A mass ratio between the crystalline polyester resin and the amorphous polyester resin in the binder resin contained in the toner of the present invention is not particularly limited and may be adjusted as appropriate; however, it is preferred that the mass ratio is 5:95 to 50:50 from the viewpoint of low-temperature fixability and hot offset resistance. If the mass ratio of the crystalline polyester resin becomes lower than 5%, the hot offset resistance may increase, whereas the low-temperature fixability may become impaired. If the mass ratio of the crystalline polyester resin becomes higher than 50%, the low-temperature fixability may increase, whereas the hot offset resistance may become impaired.

In the present invention, amorphous resins and crystalline resins are distinguished from each other by a crystallization index; and resins having the crystallization index in a range from 0.6 to 1.5 are considered as the crystalline resins, whereas resins having the crystallization index of less than 0.6 or of more than 1.5 are considered as the amorphous resin. The resins having the crystallization index of more than 1.5 are considered to be amorphous, whereas the resins having the crystallization index of less than 0.6 are low in crystallinity and high in amorphous parts.

A crystallization index is a physical property to be used as an indicator of degrees of the resin crystallization and is defined by a ratio between a softening temperature and an endothermic maximum peak temperature (softening temperature/endothermic maximum peak temperature). The endothermic maximum peak temperature is a peak temperature at its maximum on the high temperature side among endothermic peak temperatures observed. The maximum peak temperature of the crystalline polyester resin is considered as a melting point, and the peak temperature at its maximum on the high temperature side of the amorphous polyester resin is considered as a glass-transition point.

The degrees of the resin crystallization may be controlled by adjusting types and a ratio of material monomers and also manufacturing conditions (such as reaction temperatures, a reaction time, and a cooling rate).

Amorphous Polyester Resin

The amorphous polyester resin to be used for the toner of the present invention is obtained by the polycondensation of the dicarboxylic monomer—such as terephthalic acid or isophthalic acid as the main component—and the diol monomer—such as ethylene glycol as the main component.

The dicarboxylic monomer to be used to synthesize the amorphous polyester resin may be terephthalic acid or isophthalic acid as the main component. The molar content rate of terephthalic acid or isophthalic acid of the dicarboxylic monomer is preferably 70% or higher and 100% or lower, and more preferably 80% or higher and 100% or lower.

Used as the dicarboxylic monomer may be an aromatic dicarboxylic acid or an aliphatic dicarboxylic acid other than terephthalic acid and isophthalic acid. Examples of the aromatic dicarboxylic acid other than terephthalic acid and isophthalic acid include fumaric acid; and examples of the aliphatic dicarboxylic acid include adipic acid, sebacic acid, and succinic acid. The dicarboxylic monomer may also be an ester-forming derivative of terephthalic acid or isophthalic acid, an ester-forming derivative of the aromatic dicarboxylic acid other than terephthalic acid and isophthalic acid, or an ester-forming derivative of the aliphatic dicarboxylic acid. In the present invention, the ester-forming derivatives may be, for example, acid anhydrides of the carboxylic acids and alkyl esters. In a case where the dicarboxylic monomer except for terephthalic acid and isophthalic acid is used, the above-described dicarboxylic monomers may be used independently, or two or more kinds may be used in combination.

To synthesize the amorphous polyester resin, a trivalent or higher polycarboxylic monomer may be used together with the dicarboxylic monomer. Used as the trivalent or higher polycarboxylic monomer may be a trivalent or higher polycarboxylic acid, such as trimellitic acid or pyromellitic acid, or its ester-forming derivative. In a case where the trivalent or higher polycarboxylic monomer is used, the above-described polycarboxylic monomers may be used independently, or two or more kinds may be used in combination.

The diol monomer to be used to synthesize the amorphous polyester resin may be ethylene glycol as the main component. The molar content rate of ethylene glycol of the diol monomer is preferably 70% or higher and 100% or lower, and more preferably 80% or higher and 100% or lower.

The diol monomer may also be 1,3-propylene glycol, 1,4-butanediol, or the like. In a case where the diol monomer except for ethylene glycol is used, the above-described diol monomers may be used independently, or two or more kinds may be used in combination.

The amorphous polyester resin to be used for the toner of the present invention may be prepared in the same manner as a conventional polyester preparation method. For example, the amorphous polyester resin may be synthesized by a polycondensation reaction of the dicarboxylic monomer and the diol monomer and possibly the trivalent or higher polycarboxylic monomer in an atmosphere of a nitrogen gas at 190 to 240° C.

For the polycondensation reaction, a reaction ratio between the diol monomer and the carboxylic monomer (such as the dicarboxylic monomer and possibly the trivalent or higher polycarboxylic monomer) is preferably 1.3:1 to 1:1.2 as an equivalent ratio [OH]:[COOH] of a hydroxyl group and a carboxyl group. For the polycondensation reaction, a molar content rate of the dicarboxylic monomer in the carboxylic monomer is preferably 80 to 100%. For the polycondensation reaction, the esterification catalyst, such as dibutyltin oxide or titanium alkoxide (for example, tetrabutoxy titanate), may be used as needed.

A glass-transition temperature ($T_g$) of the amorphous polyester resin is preferably 50 to 70° C. from the viewpoint of fixability, storage stability, durability, and others. If the glass-transition temperature goes beyond this range, the fixability, the storage stability, and the durability may become out of balance.

A softening point ($T_m$) of the amorphous polyester resin is preferably 100 to 150° C. from the viewpoint of low-temperature fixability and hot offset resistance. If the softening point goes beyond this range, the low-temperature fixability and the hot offset resistance may become out of balance.

A molecular weight of the amorphous polyester resin is preferably 3,000 to 10,500 from the viewpoint that a peak top molecular weight ($M_p$) of a tetrahydrofuran (THF) soluble part measured by a gel permeation chromatography (GPC) controls a balance of heat resistance, heat storage stability, and low-temperature fixability of the toner. If the peak top molecular weight goes beyond the range of 3,000 to 10,500, the balance of the heat resistance, the heat storage stability, and the low-temperature fixability of the toner may become imbalance.

GPC uses tetrahydrofuran (THF) as a mobile phase, and also uses polystyrene as a standard substance. The peak top molecular weight indicates a molecular weight at a highest peak height in a chromatogram obtained by the GPC measurement.

An acid value of the amorphous polyester resin is preferably 0 to 60 mg KOH/g from the viewpoint of charging characteristics, and a hydroxyl value of the amorphous polyester resin is preferably 0 to 50 mg KOH/g from the viewpoint of the hot offset resistance. If the acid value becomes higher than 60 mg KOH/g, the charging efficiency may become degraded; and if the hydroxyl value becomes higher than 50 mg KOH/g, the hot offset resistance may become insufficient.

A solubility parameter (SP) value of the amorphous polyester resin is preferably 10.5 to 12.5.

A content of the amorphous polyester resin in the toner of the present invention is not particularly limited; however, the content is preferably 50 to 80% by mass in the toner base particles.

Crystalline Polyester Resin

The crystalline polyester resin to be used for the toner of the present invention is obtained by the polycondensation of the dicarboxylic monomer—such as the aliphatic dicarboxylic acid having 9 to 22 carbon atoms as the main component—and the diol monomer—such as the aliphatic diol having 2 to 10 carbon atoms as the main component—and contains a linear saturated aliphatic polyester unit. Because of containing the linear saturated aliphatic polyester unit, the crystalline polyester resin is not likely to be compatible with the amorphous polyester resin.

The dicarboxylic monomer to be used to synthesize the crystalline polyester resin may be the aliphatic dicarboxylic acid having 9 to 22 carbon atoms as the main component. A molar content rate of the aliphatic dicarboxylic acid having 9 to 22 carbon atoms of the dicarboxylic monomer is preferably 80% or higher and 100% or lower.

Examples of the aliphatic dicarboxylic acid having 9 to 22 carbon atoms include azelaic acid, sebacic acid, 1,10-decane dicarboxylic acid, and 1,18-octadecane dicarboxylic acid. The dicarboxylic monomer may also be ester-forming derivatives of these aliphatic dicarboxylic acids. These dicarboxylic monomers may be used independently, or two or more kinds may be used in combination.

To synthesize the crystalline polyester resin, a trivalent or higher polycarboxylic monomer may be used together with the dicarboxylic monomer. Used as the trivalent or higher polycarboxylic monomer may be a trivalent or higher polycarboxylic acid, such as trimellitic acid or pyromellitic acid, or its ester-forming derivative. In a case where the trivalent or higher polycarboxylic monomer is used, the above-described polycarboxylic monomers may be used independently, or two or more kinds may be used in combination.

The diol monomer to be used to synthesize the crystalline polyester resin may be the aliphatic diol having 2 to 10 carbon atoms as the main component. A molar content rate of the aliphatic diol having 2 to 10 carbon atoms of the diol monomer is preferably 80% or higher and 100% or lower.

Examples of the aliphatic diol having 2 to 10 carbon atoms include ethylene glycol, 1,4-butanediol, and 1,6-hexanediol. These diol monomers may be used independently, or two or more kinds may be used in combination.

To synthesize the crystalline polyester resin, a trivalent or higher polyol monomer may be used together with the diol monomer. Used as the trivalent or higher polyol monomer may be glycerin, trimethylol propane, or the like. In a case where the trivalent or higher polyol monomer is used, the above-described polyol monomers may be used independently, or two or more kinds may be used in combination.

The crystalline polyester resin to be used for the toner of the present invention may be prepared in the same manner as a conventional polyester preparation method. For example, the crystalline polyester resin may be synthesized by a polycondensation reaction of the dicarboxylic monomer and the diol monomer and possibly the trivalent or higher polycarboxylic monomer and/or the trivalent or higher polyol monomer in an atmosphere of a nitrogen gas at 190 to 240° C.

For the polycondensation reaction, an equivalent ratio (OH group/COOH group) between the hydroxyl group of the polyol monomer (such as the diol monomer and possibly the trivalent or higher polyol monomer) and the carboxyl group of the carboxylic monomer (such as the dicarboxylic monomer and possibly the trivalent or higher polycarboxylic monomer) is preferably 0.83 to 1.3 from the viewpoint of the storage stability and others. For the polycondensation reaction, a molar content rate of the dicarboxylic monomer of the carboxylic monomer is preferably 90 to 100%. The lower the molar content rate of the dicarboxylic monomer is, the lower a percentage and a speed of the crystallization is, resulting in insufficient toner aggregation resistance. For the polycondensation reaction, a molar content rate of the diol monomer of the polyol monomer is preferably 80 to 100%. For the polycondensation reaction, the esterification catalyst, such as dibutyltin oxide or titanium alkoxide (for example, tetrabutoxy titanate), may be used as needed.

A melting point ($T_{mp}$) of the crystalline polyester resin is preferably 40° C. or higher, and more preferably 60 to 90° C. from the viewpoint of the fixability, the storage stability, the durability, and others. If the melting point becomes lower than 40° C., the durability may become insufficient. If the melting point becomes 90° C. or higher, the fixability may become insufficient.

A softening point ($T_m$) of the crystalline polyester resin is preferably 65 to 110° C. from the viewpoint of the low-temperature fixability and blocking resistance. If the softening point goes beyond this range, the low-temperature fixability and/or the blocking resistance may become insufficient.

A ratio ($T_m/T_{mp}$) between the softening point ($T_m$) and the melting point ($T_{mp}$) of the crystalline polyester resin is preferably 1.0 to 1.4 from the viewpoint of the crystallization speed and the blocking resistance. If the ratio between the softening point and the melting point goes beyond this range, the crystallization speed and/or the blocking resistance may become insufficient.

A molecular weight of the crystalline polyester resin is preferably 10,000 to 90,000 from the viewpoint that a peak top molecular weight ($M_p$) of a tetrahydrofuran (THF) soluble part measured by a gel permeation chromatography (GPC) controls storage stability, low-temperature fixability, and others. The GPC uses tetrahydrofuran (THF) as a mobile phase, and also uses polystyrene as a standard substance. The peak top molecular weight indicates a highest peak height of the molecular weight in a chromatogram obtained by the GPC measurement. If the peak top molecular weight goes beyond the above-mentioned range, the storage stability and/or the low-temperature fixability may become insufficient.

An acid value of the crystalline polyester resin is preferably 0 to 60 mg KOH/g from the viewpoint of charging characteristics, and a hydroxyl value of the crystalline polyester resin is preferably 0 to 40 mg KOH/g from the viewpoint of the hot offset resistance. If the acid value becomes higher than 60 mg KOH/g, the charging efficiency may become degraded; and if the hydroxyl value becomes higher than 40 mg KOH/g, the hot offset resistance may become insufficient.

A solubility parameter (SP) value of the crystalline polyester resin is preferably 9.3 to 10.0. If the SP value becomes lower than 9.3, the crystalline polyester resin may become too low in compatibility with the amorphous polyester resin, and the durability may become insufficient. If the SP value exceeds 10.0, the glass-transition temperature $T_g$ of the binder resin may decrease, and the blocking resistance may decrease.

In the toner of the present invention, a content of the crystalline polyester resin is not particularly limited; however, its content is preferably 10 to 30% by mass in the toner base particles.

Detaching Agent

To give detachability to the toner, the detaching agent is added to the toner at a time when the toner fixes to a recording medium. In the toner of the present invention, the detaching agent is dispersed in the amorphous polyester resin.

The detaching agent to be added to the toner of the present invention is not particularly limited; and any detaching agent commonly used in the relevant field may be used, such as polypropylene wax, polyethylene wax and its derivatives, microcrystalline wax, carnauba wax, rice wax, candelilla wax, or synthetic ester-based wax. Used as the synthetic ester-based wax is, for example, Nissan Electol wax (WEP-2, WEP-3, WEP-4, WEP-5, WEP-6, WEP-7, WEP-8, WEP-9, or WEP-10 manufactured by NOF Corporation).

Of these waxes, monoester-based waxes are preferable. For example, Nissan Electol wax is preferable (WEP-2, WEP-3, or the like manufactured by NOF Corporation; or N-252, N-272, or the like manufactured by Chukyo Yushi Co., Ltd.).

The reasons why the monoester-based waxes are preferable are that these waxes are high in polarity, are likely to be compatible with the amorphous polyester resin, and are stable in structure. For these reasons, these waxes are stable in structure even after being heated, leading to excellent thermal tolerance.

In the meanwhile, a diester-based waxes are unstable in structure compared with the monoester-based waxes. The diester-based waxes are likely to come to be stable energetically after being heated, leading to a bleeding-out phenomenon and inferior thermal tolerance.

In the toner of the present invention, a content of the detaching agent is not particularly limited; however, its content is preferably 1 to 5% by mass in the toner base particles.

Colorants

Used as the colorants may be any publicly known pigments or dyes that are commonly used in the toner. More specifically, the following colorants may be used.

Used as a colorant for a black toner may be, for example, carbon black or magnetite.

Used as the colorant for a yellow toner may be, for example, an acetoacetic arylamide-based monoazo yellow pigment such as C.I. pigment yellow 1, C.I. pigment yellow 3, C.I. pigment yellow 74, C.I. pigment yellow 97, or C.I. pigment yellow 98; an acetoacetic arylamide-based disazo yellow pigment such as C.I. pigment yellow 12, C.I. pigment yellow 13, C.I. pigment yellow 14, or C.I. pigment yellow 17; a condensed monoazo-based yellow pigment such as C.I. pigment yellow 93 or C.I. pigment yellow 155; other yellow pigment such as C.I. pigment yellow 180, C.I. pigment yellow 150, or C.I. pigment yellow 185; or a yellow dye such as C.I. solvent yellow 19, C.I. solvent yellow 77, C.I. solvent yellow 79, or C.I. disperse yellow 164.

Used as the colorant for a magenta toner may be, for example, a red or pink pigment such as C.I. pigment red 48, C.I. pigment red 49:1, C.I. pigment red 53:1, C.I. pigment red 57, C.I. pigment red 57:1, C.I. pigment red 81, C.I. pigment red 122, C.I. pigment red 5, C.I. pigment red 146, C.I. pigment red 184, C.I. pigment red 238, or C.I. pigment violet 19; or a red dye such as C.I. solvent red 49, C.I. solvent red 52, C.I. solvent red 58, or C.I. solvent red 8.

Used as the colorant for a cyan toner may be, for example, a blue pigment of copper phthalocyanine or its derivatives such as C.I. pigment blue 15:3 or C.I. pigment blue 15:4, or a green pigment such as C.I. pigment green 7 or C.I. pigment green 36 (phthalocyanine green).

In the toner of the present invention, contents of the colorants are not particularly limited; however, their contents are preferably 2 to 10% by mass in the toner base particles.

Charge-Controlling Agent

The charge-controlling agent is added to the toner so as to give desirable chargeability to the toner. The charge-controlling agent to be used in the toner of the present invention is to control a positive electric charge or a negative electric charge.

Examples of the charge-controlling agent for controlling the positive electric charge include a nigrosine dye and its derivatives, triphenylmethane derivatives, quaternary ammonium salt, quaternary phosphonium salt, quaternary pyridinium salt, guanidine salt, and amidine salt.

Examples of the charge-controlling agent for controlling the negative electric charge include a chrome azo complex dye, an iron azo complex dye, a cobalt azo complex dye, chrome-zinc-aluminum-boron complex or chloride of salicylic acid or its derivatives, chrome-zinc-aluminum-boron complex or chloride of naphthol acid or its derivatives, chrome-zinc-aluminum-boron complex or chloride of benzilic acid or its derivatives, long-chain alkyl-carboxylate, and long-chain alkyl-sulfonate. In the toner of the present invention, a content of the charge-controlling agent is not particularly limited; however, its content is preferably 0.5 to 5% by mass in the toner base particles.

The charge-controlling agents may be used independently, or two or more kinds may be used in combination as the need arises.

External Additive

The external additive may be added to the toner of the present invention.

Used as the external additive may be any of external additives that are commonly used in the relevant technical field; and examples of the external additive include silica, titanium oxide, silicon carbide, aluminum oxide, and barium titanate. It is, however, preferable that the external additive should be subjected to a surface treatment (a hydrophobizing treatment) with a silicone resin or a silane coupling agent, from the viewpoint that the toner particles should be prevented from adhering to each other.

In the present invention, the above-described external additives may be used independently, or two or more kinds may be used in combination.

In the present invention, it is preferable that several kinds of the external additives should be used that are different in average particle diameter. From the viewpoint of improving transcription efficiency, it is preferable that the at least one kind out of the several kinds of the external additives should be 0.1 μm or more in average particle diameter and that the several kinds of the external additives should be 0.2 μm or less in average particle diameter.

In a case where two kinds of the external additives are used that are different in average particle diameter, it is preferable that the smaller one of the two kinds should be 0.007 to 0.5 μm in average particle diameter and that the larger one should be 0.5 to 2.0 μm in average particle diameter; and it is preferable that a ratio of the average particle diameter between the smaller one and the larger one should be 1:5 to 1:20.

A content of the external additive is not particularly limited; however, its content is preferably 0.1 to 3.0 parts by weight with respect to 100 parts by weight of the toner base particles; and it is particularly preferable that its content should be 0.5 to 1.0 parts by weight.

The external additive having the content within the above-described range enables a formed image to have a high image density and high image quality without losing the various physical properties of the toner.

Toner Preparation Method

In the following, a method for preparing the toner of the present invention will be explained. The toner of the present invention may be prepared by a publicly known method such as a kneading-grinding method or a condensation method. For example, to prepare a toner of the present invention by the kneading-grinding method, a binder resin containing an amorphous polyester resin and a crystalline polyester resin is mixed with internal additives, such as a detaching agent, a colorant, and a charge-controlling agent that may be properly selected as needed, by use of an airflow mixer, such as a Henschel mixer; the obtained raw material mixture is kneaded at about 100 to 180° C. by use of a melt-kneading machine, such as a two-axis kneading machine or an open roll kneader. The obtained molten-kneaded mixture is cooled and solidified; and the solidified product is milled by use of an air-type milling machine, such as a jet mill, and is subjected to size control, such as classifying, as needed, so as to prepare toner base particles. A common practice of how to add an external additive is to mix the toner base particles with the external additive by use of an airflow mixer, such as a Henschel mixer.

Carrier Cores (Also Known as "Core Particles")

Carrier cores are not particularly limited; and any carrier cores commonly used in the relevant technical field may be used—for example, a magnetic metal such as iron, copper, nickel, or cobalt, or a magnetic metal oxide such as ferrite or magnetite. Any of these carrier cores may become suitable carriers for a developer to be used in a magnetic brush development method.

Of these carrier cores, the particles containing the ferrite component are preferable. The ferrite is high in saturated magnetization and can serve as low-density coat carriers; and the developer containing the ferrite is not thus likely to cause adhesion of the coat carriers to a photoreceptor, with the result that a soft magnetic brush may be formed, and an image that is high in dot reproduction may be formed.

Examples of the ferrite include zinc-based ferrite, nickel-based ferrite, copper-based ferrite, barium ferrite, strontium ferrite, nickel-zinc-based ferrite, manganese-magnesium-based ferrite, copper-magnesium-based ferrite, manganese-zinc-based ferrite, manganese-copper-zinc-based ferrite, and manganese-magnesium-strontium-based ferrite.

The ferrite may be prepared by any publicly known method. For example, ferrite materials are mixed, such as $Fe_2O_3$ and $Mg(OH)_2$; this mixed powder is tentatively heated by a furnace. This heated product is cooled and then milled by use of a vibrational mill until being about 1 μm particles; and a dispersant and water are added to the milled powder so as to obtain a slurry. This slurry is subjected to wet crushing in a wet ball mill, and the obtained suspension is dried by a spray dryer until being pelletized so as to obtain ferrite particles.

The carrier cores are preferably 25 to 100 μm in average particle diameter, and more preferably 25 to 90 μm.

The carrier cores having the average particle diameter within the above-described range enable the toner to be stably conveyed to an electrostatic latent image formed on the photoreceptor, and are capable of forming high-definition images over a prolonged period.

If the average particle diameter of the carrier cores is less than 25 μm, it may be difficult to control the carrier adhesion. If the average particle diameter of the carrier cores exceeds 100 μm, high-definition images may not be formed.

Resin to be Contained in Carriers

A resin to form a resin layer is not particularly limited; and any resin commonly used in the relevant technical field may be used, such as a polyester resin, an acrylic resin, an acrylic denatured resin, a silicone resin, or a fluorine resin.

In the present invention, the above-described resins may be used independently, or two or more kinds may be used in combination.

Examples of the acrylic resin include polyacrylate, polymethylmethacrylate, polyethylmethacrylate, poly-n-butylmethacrylate, polyglycidylmethacrylate, fluorine-containing polyacrylate, styrene-methacrylate copolymer, styrene-butylmethacrylate copolymer, styrene-ethyl acrylate copolymer.

Examples of the commercially available acrylic resin include Dianal SE-5437 manufactured by Mitsubishi Rayon Co., Ltd., S-LEC PSE-0020 manufactured by Sekisui Chemical Co., Ltd., Himer ST95 manufactured by Sanyo Chemical Industries, Co., Ltd., and FM601 manufactured by Mitsui Chemicals, Inc.

Examples of other resins include epoxy resins, urethane resins, phenol resins, acrylic resins, styrene resins, polyamides, polyesters, acetal resins, polycarbonates, vinyl chloride resins, polyvinyl acetate resins, cellulose resins, polyolefins, fluorine resins, copolymer resins thereof, and compounded resins; and of these resins, the acrylic resins are preferable because of high charging ability. To improve properties of the resin layer, such as humidity resistance and detachability, formed of the silicone resin (especially, a cross-linking silicone resin), the resin layer may contain bifunctional silicone oil.

Magnetic Microparticles

Magnetic microparticles may contain the same material as the carrier cores.

The magnetic microparticles of the present invention have the above-described specific physical properties; however, the magnetic microparticles that do not have such physical properties can obtain these physical properties if these magnetic microparticles are subjected to a high-resistivity treatment such as a surface oxidation treatment.

One example of the surface oxidation treatment is flow oxidation to be carried out at 250 to 500° C. in an oxidant atmosphere, such as in the air.

The magnetic microparticles are preferably 0.05 to 0.8 μm in average particle diameter, and more preferably 0.08 to 0.5 μm.

The magnetic microparticles having the average particle diameter within the above-described range can be stably prevented from being eccentrically located in the resin layer and between the carriers during the formation of the resin layer on the surfaces of the carrier cores. Also, such magnetic microparticles do not bring about the formation of an uneven surface of the resin layer, resulting in a uniform resin layer. Although reason for this remains uncertain, it is conceivable that the metal oxide microparticles are retained uniformly because of a magnetic force among the metal oxide microparticles.

In a case where the magnetic microparticles as the raw material do not have the appropriate average particle diameter, the magnetic microparticles may be subjected to a milling treatment or a classifying treatment by use of any publicly known apparatus, such as a sand mill, before being subjected to the above-described high-resistivity treatment. The treatments will be specifically explained in Examples below.

A content of the magnetic microparticles is not particularly limited; however, their content is preferably 0.05 to 65 parts by weight with respect to 1,000 parts by weight of the carrier cores; and more preferably 0.5 to 40 parts by weight.

The magnetic microparticles having the content within the above-described range can exert excellent effects of the present invention.

Namely, the content of the magnetic microparticles in the resin layer is preferably 1 to 183 parts by weight with respect to 100 parts by weight of the resin; and more preferably 10 to 133 parts by weight.

If the content of the magnetic microparticles becomes lower than 1 part by weight, the magnetic microparticles may not exert the effects sufficiently. If the content of the magnetic microparticles exceeds 183 parts by weight, the resin layer may not be formed uniformly.

Electrically Conductive Microparticles

It is preferable that the resin layer should contain electrically conductive microparticles.

The resin layer containing the electrically conductive microparticles is capable of improving charge-adding ability from the carriers to the toner in a more stable manner. Namely, the electrically conductive microparticles are unlikely to charge up the carriers.

The electrically conductive microparticles are not particularly limited; and any electrically conductive microparticles commonly used in the relevant technical field may be used, such as oxides including conductive carbon black, conductive titanium oxide, and conductive tin oxide.

The carbon black can develop electrical conductivity even if its content is low, and is suitable for a black toner. There is, however, apprehension that the carbon black may become detached from the resin layer; therefore, the conductive titanium oxide or the like doped with antimony is desirable as a color toner.

A content of the electrically conductive microparticles is not particularly limited; however, their content is preferably 1 to 25 parts by weight with respect to 100 parts by weight of the resin; and more preferably 1 to 20 parts by weight.

If the content of the electrically conductive microparticles becomes lower than 1 part by weight, the electrically conductive microparticles may not exert the effects. If the content of the electrically conductive microparticles exceeds 25 parts by weight, the resin layer may not be formed uniformly.

Preparation of Carriers

The carriers of the present invention may be prepared through the following steps: A liquid resin in which constituents of the above-described resin layer are dissolved or dispersed in a solvent is applied to surfaces of carrier cores; the solvent is then volatized and removed so as to form a coating layer; and the coating layer is heated and hardened, or simply hardened, during or after being dried.

The solvent is not particularly limited; and any solvent that dissolves the resin may be used. Examples of the solvent include aromatic carbon hydrides such as toluene and xylene; ketones such as acetone and methyl ethyl ketone; ethers such as tetrahydrofuran and dioxane; and organic solvents such as higher alcohols. The solvents may be used independently, or two or more kinds may be used in combination.

How to apply the liquid resin to the surfaces of the carrier cores may be adopted from any publicly known method. Examples of this method include a dipping method in which the carrier cores are immersed in the liquid resin; a spray method in which the liquid resin is sprayed on the carrier cores; a fluid bed method in which the liquid resin is sprayed on the carrier cores while the carrier cores float in the flowing air; and a kneader-coater method in which the carrier cores and the liquid resin are mixed in a kneader-coater, and the solvent is removed. Of these methods, the spray method is preferable since this method can minimize the exposure of the magnetic core particles.

The coating solution layer may be dried with use of a drying accelerator.

Used as the drying accelerator may be any of those publicly known as drying accelerators; and examples of the drying accelerator include metal soaps such as lead salt, iron salt, cobalt salt, manganese salt, and zinc salt containing naphthyl acid, octyl acid, or the like; and organic amines such as ethanolamine. The drying accelerators may be used independently, or two or more kinds may be used in combination. A content of the drying accelerator is of the order of 0.1 to 5 parts by weight with respect to 100 parts by weight of the solvent.

To harden the coating solution layer, a heating temperature may be properly determined depending on the type of the resin or the solvent; and the heating temperature may be, for example, of the order of 150 to 280° C. If a normothermic hardening silicone resin is used as the resin to be applied to the carrier core surfaces, this silicone resin may not be necessarily heated, but may be heated at about 150 to 280° C. for the purpose of improving a mechanical strength of the resin layer to be formed or shortening the hardening time.

A total solid concentration of the liquid resin is not particularly limited; however, the total solid concentration may be adjusted in such a way that the resin layer is hardened to be usually 5 μm or less in thickness, preferably about 0.1 to 3 μm, in consideration of coating applicability or the like of the liquid resin on the carrier cores.

It is preferable that the carriers obtained in this manner should have a high electrical resistance and should be in a spherical shape; however, even if the carriers are electrically conductive or are non-spherical, this does not ruin any effects of the present invention.

Two-Component Developer

In the following, a two-component developer to contain the carriers of the present invention will be explained. The two-component developer is characterized by containing the toner of the present invention and the carriers, both of which are described above; and the two-component developer may be prepared by mixing the toner and the carriers by use of, for example, a mixer such as a Nauta mixer (trade name: VL-0, manufactured by Hosokawa Micron Corporation).

A ratio between the toner and the carriers is preferably a mass ratio of, for example, 10:90 to 5:95.

EXAMPLES

In the following, the present invention will be explained in detail through the use of Examples and Comparative Examples; however, the present invention should not be limited to these Examples.

Determination of Softening Points ($T_m$) of Binder Resin and Milling Aid Resin

By use of a rheological characterization apparatus (manufactured by Shimadzu Corporation, flow tester, model number: CFT-100C), 1 g of a sample is heated at a rate of temperature increase of 6° C./min under a load of 20 kgf/cm$^2$ ($9.8\times10^5$ Pa); and the sample is outpoured from a die (1 mm in nozzle diameter and 1 mm in length). A temperature of the sample at a time when half the amount of the sample is outpoured is considered to be a softening point ($T_m$).

Determination of Glass-Transition Temperatures ($T_g$) of Binder Resin and Milling Aid Resin By use of a differential scanning calorimeter (manufactured by Seiko Denshi Kogyo (currently, Seiko Instruments, Inc.), model number: DSC220), 1 g of a sample is heated at a rate of temperature increase of 10° C./min so as to measure a DSC curve line according as Japanese Industrial Standards (JIs) K7121-1987. A temperature at a point of intersection of the following two lines is considered as a glass-transition temperature ($T_g$): a straight line, which is estimated from the DSC curve line, extending from a base line on the high temperature side of an endothermic peak, which corresponds to the glass transition, to the low temperature side; and a tangent line drawn from a point in such a way that a slope of the DSC curve line from its starting point to its ending point is maximum.

Measurement of Melting Point of Detaching Agent

By use of a differential scanning calorimeter (manufactured by Seiko Denshi Kogyo (currently, Seiko Instruments, Inc.), model number: DSC220), 1 g of a sample is heated at a rate of temperature increase of 10° C./min from 20° C. to 200° C. and then is rapidly cooled from 200° C. to 20° C.; and this process is repeated twice to measure a DSC curve line. A temperature of an endothermic peak, which corresponds to a melting temperature on the DSC curve line, measured during the second process is considered as a melting point of the detaching agent.

Determination of Volume Average Particle Diameter of Toner Base Particles 20 mg of a sample and 1 ml of alkyl ether sulfuric ester sodium are added to 50 ml of an electrolytic solution (manufactured by Beckman Coulter, Inc., trade name: ISOTON-II); and the mixture is subjected to a dispersion treatment for 3 min at a frequency of 20 kHz by use of an ultrasonic disperser (manufactured by AS ONE Corporation, a desktop dual frequency ultrasonic cleaner, model number: VS-D100) so as to obtain a sample for measurement. The obtained sample for measurement is measured under the following conditions by use of a particle size analyzer (manufactured by Beckman Coulter, Inc., model number: Multisizer 3) to obtain a volume average particle diameter from volumetric size distribution of the sample particles: 100 μm of an aperture diameter and 50,000 particles.

Determination of Dispersion Diameters of Aggregate

The prepared toner was embedded in an epoxy resin, and was subjected to a surface shaping by use of an ultramicrotome (manufactured by Reichert, Inc., trade name: Ultracut N) so as to prepare a sample. The obtained sample was scanned to obtain a dispersion diameter of the monoester-based wax and a dispersion diameter of the crystalline polyester resin by use of a scanning electron microscope (manufactured by Hitachi High-Technologies Corporation, model number: S-4800). 200 to 300 detaching agent particles were randomly selected on the basis of the obtained electron micrograph data, and were subjected to an image analysis by use of an image analysis software (trade name: A-zo kun, manufactured by Asahi Kasei Engineering Corporation) so as to obtain equivalent circle diameters of the detaching agent particles.

Measurement of SP Values

The SP values were measured as follows in accordance with a method by Suh and Clarke (Suh, K. W. and Clarke, D. H. "Cohesive Energy Densities of Polymers from Turbidimetric Titrations." *Journal of Polymer Science*. A-1. 5. 1967. 1671-1681).

0.5 g of a detaching agent to be measured was placed in a 100-ml beaker, 10 ml of a good solvent (mixed solution of dioxane and acetone) was added thereto by use of a whole pipette, the mixture was stirred with a magnetic stirrer and was dissolved, and a hydrophobic solvent (mixed solution of n-hexane and ion-exchange water) was added dropwise by use of a 50-ml burette; and dropping amounts of the mixture were measured at a time when turbidity was observed at a measurement temperature of 20° C.

An SP value δ of the detaching agent was calculated from the measured value according to the following formula (3):

$$\delta=(Vl/2\delta l+Vh/2\delta h)/(Vl/2+Vh/2) \quad (3)$$

wherein the member Vl is a molecular volume (ml/mol) of the solvent in the low SP solvent (hydrophobic solvent) miscible system; the member Vh is a molecular volume (ml/mol) of the solvent in the high SP solvent (good solvent) miscible system; the member 61 is an SP value of the solvent in the low SP solvent (hydrophobic solvent) miscible system; and the member βh is an SP value of the solvent in the high SP solvent (good solvent) miscible system.

Preparation Example 1

Preparation of Amorphous Polyester Resin PA1

To a reaction vessel, 440 g of terephthalic acid (2.7 mol), 235 g of isophthalic acid (1.4 mol), 7 g of adipic acid (0.05 mol), 554 g of ethylene glycol (8.9 mol), and 0.5 g of tetrabutoxytitanate as a polymerization catalyst were introduced; and the mixture was allowed to react for 5 hours while water and ethylene glycol were distilled away from the mixture at 210° C. in a nitrogen stream, and then allowed to react under reduced pressure of 5 to 20 mmHg for 1 hour. Then 103 g of trimellitic anhydride (0.54 mol) was added; and the mixture was allowed to react at normal pressure for 1 hour and to react under reduced pressure of 20 to 40 mmHg so as to collect a resin at a predetermined softening point. An amount of the collected ethylene glycol was 219 g (3.5 mol). The obtained resin was cooled to room temperature and then was ground to particles. These particles were determined as an amorphous polyester resin PA1. The amorphous polyester resin PA1 resulted in $T_g$ of 56° C., $T_m$ of 135° C., $M_p$ of 4,800, acid value of 37 mg KOH/g, and hydroxyl value of 50 mg KOH/g.

Preparation Example 2

Preparation of Amorphous Polyester Resin PA2

To a reaction vessel, 310 g of terephthalic acid (1.9 mol), 465 g of isophthalic acid (2.8 mol), 36 g of adipic acid (0.25 mol), 610 g of ethylene glycol (9.8 mol), and 0.5 g of tetrabutoxytitanate as a polymerization catalyst were introduced; and the mixture was allowed to react for 5 hours while water and ethylene glycol were distilled away from the mixture at 210° C. in a nitrogen stream, and then allowed to react under reduced pressure of 5 to 20 mmHg for 1 hour. Then 52 g of trimellitic anhydride (0.27 mol) was added; and the mixture was allowed to react at normal pressure for 1 hour and then to react under reduced pressure of 20 to 40 mmHg so as to collect a resin at a predetermined softening point. An amount of the collected ethylene glycol was 262 g (4.2 mol). The obtained resin was cooled to room temperature and then was ground to particles. These particles were determined as an amorphous polyester resin PA2. The amorphous polyester resin PA2 resulted in $T_g$ of 60° C., $T_m$ of 150° C., $M_p$ of 10,500, acid value of 10 mg KOH/g, and hydroxyl value of 0 mg KOH/g.

Preparation Example 3

Preparation of Crystalline Polyester Resin B

To a reaction vessel, 132 g of 1,6-hexanediol (1.12 mole), 230 g of 1,10-decane dicarboxylic acid (1.0 mol), and 3 g of tetrabutoxytitanate as a polymerization catalyst were introduced; and the mixture was allowed to react for 5 hours while water was distilled away from the mixture at 210° C. at normal pressure. The reaction was allowed continuously under reduced pressure of 5 to 20 mmHg, and a resin was collected at a time when an acid value reached to lower than 2 mg KOH/g. The obtained resin was cooled to room temperature and was ground to particles. These particles were determined as a crystalline polyester resin B. The crystalline polyester resin B resulted in $T_{mp}$ of 66° C., $T_m$ of 73° C. ($T_m/T_{mp}$=1.1), and $M_p$ of 13,500.

Preparation Example 4

Preparation of Crystalline Polyester Resin C

To a reaction vessel, 132 g of 1,6-hexanediol (1.12 mole), 343 g of 1,18-octadecane dicarboxylic acid (1.0 mol), and 3 g of tetrabutoxytitanate as a polymerization catalyst were introduced; and the mixture was allowed to react for 5 hours while water was distilled away from the mixture at 210° C. at normal pressure. The reaction was allowed continuously under reduced pressure of 5 to 20 mmHg, and a resin was collected at a time when an acid value reached to lower than 2 mg KOH/g. The obtained resin was cooled to room temperature and was ground to particles. These particles were determined as a crystalline polyester resin C.

Preparation Example 5

Preparation of Crystalline Polyester Resin D

To a reaction vessel, 121 g of 1,6-hexanediol (1.03 mole), 343 g of 1,18-octadecane dicarboxylic acid (1.0 mol), and 3 g of tetrabutoxytitanate as a polymerization catalyst were introduced; and the mixture was allowed to react for 5 hours while water was distilled away from the mixture at 210° C. at normal pressure. The reaction was allowed continuously under reduced pressure of 5 to 20 mmHg, and a resin was collected at a time when an acid value reached to lower than 2 mg KOH/g. The obtained resin was cooled to room temperature and was ground to particles. These particles were determined as a crystalline polyester resin D.

The crystalline polyester resin D resulted in $T_{mp}$ of 73° C., $T_m$ of 93° C. ($T_m/T_{mp}$=1.4), and $M_p$ of 90,000. In Examples and Comparative Examples, physical property values were measured in the following way.

Example 1

| | |
|---|---|
| Binder resin: polyester resin A (glass-transition temperature of 62° C., softening point of 115° C., weight average molecular weight of 65,000) | 79% by weight |
| Colorant: colorant (C.I. Pigment Blue 15:3, manufactured by DIC) | 7% by weight |
| Detaching agent: monoester-based wax E (melting point of 73° C., manufactured by NOF Corporation, trade name: WEP-3) | 5% by weight |
| Charge-controlling agent: salicylic acid-based compound (manufactured by Orient Chemical Industries Co., Ltd., trade name: Bontron E-84) | 1% by weight |
| Crystalline polyester resin: crystalline polyester resin B (melting point of 80° C.) | 10% by weight |

The above-listed toner materials, except for the detaching agent E, were pre-mixed for 5 minutes by use of a Henschel mixer (manufactured by Mitsui Mining Co., Ltd. (currently, Nippon Coke & Engineering Co., Ltd.), model number: FM20C)), and then were melted and kneaded by use of an open roll continuous kneader (trade name: MOS 320-1800, manufactured by Mitsui Mining Co., Ltd.). Conditions for the open-roll setting were as follows: A supply-side temperature of a heating roller was set at 130° C., and its ejection-side temperature was set at 100° C.; and a supply-side temperature of a cooling roller was set at 40° C., and its ejection-side temperature was set at 25° C. The heating roller and the cooling roller were 320 mm in diameter, and 1,550 mm in effective length; and a gap between these rollers on each of the supply side and the ejection side was 0.3 mm. A rotating speed of the heating roller was 75 rpm, and a rotating speed of the cooling roller was 65 rpm; and a supplied amount of the toner materials was 5.0 kg/h.

The obtained molten-kneaded mixture was cooled by a cooling belt, and was coarsely milled by use of a speed mill having a φ 2 mm screen; the coarse particles were then finely milled by use of a jet milling machine (manufactured by Nippon Pneumatic Mfg. Co., Ltd., model number: IDS-2); and the fine particles were classified by use of an elbow-jet classifier (manufactured by Nittetsu Mining Co., Ltd., model number: EJ-LABO) so as to obtain 6.7 μm toner particles. The crystalline polyester resin B had a was dispersion diameter of 200 nm (average particle diameter: C-PES dispersion diameter), and the monoester-based wax E had a dispersion diameter of 500 nm (average particle diameter). The difference in SP value—Δ SP value—was 1.5 $(cal/cm^3)^{1/2}$.

Example 2

Toner base particles were obtained in the same manner as in Example 1 except that the crystalline polyester resin B was replaced by a crystalline polyester resin C. The crystalline polyester resin B had a dispersion diameter of 100 nm (average particle diameter: C-PES dispersion diameter), and the monoester-based wax E had dispersion diameter of 500 nm (average particle diameter). The difference in SP value—Δ SP value—was 1.3 $(cal/cm^3)^{1/2}$.

Example 3

Toner base particles were obtained in the same manner as in Example 1 except that the monoester-based wax E was replaced by a monoester-based wax F (manufactured by Chukyo Yushi Co., Ltd., N-252, melting point of 75° C.). The crystalline polyester resin B had a dispersion diameter of 200 nm (average particle diameter: C-PES dispersion diameter), and the monoester-based wax F had a dispersion diameter of 700 nm (average particle diameter). The difference in SP value—Δ SP value—was 1.5 $(cal/cm^3)^{1/2}$.

Example 4

Toner base particles were obtained in the same manner as in Example 3 except that the crystalline polyester B was replaced by a crystalline polyester resin C. The crystalline polyester resin B had a dispersion diameter of 100 nm (average particle diameter: C-PES dispersion diameter), and the monoester-based wax F had a dispersion diameter of 700 nm (average particle diameter). The difference in SP value—Δ SP value—was 1.3 $(cal/cm^3)^{1/2}$.

Example 5

Toner base particles were obtained in the same manner as in Example 1 except that the monoester-based wax E was replaced by a monoester-based wax G (manufactured by Chukyo Yushi Co., Ltd., N-272, melting point of 68° C.). The crystalline polyester resin B had a dispersion diameter of 200 nm (average particle diameter: C-PES dispersion diameter), and the monoester-based wax G had a dispersion diameter of 500 nm (average particle diameter). The difference in SP value—Δ SP value—was 1.5 $(cal/cm^3)^{1/2}$.

Comparative Example 1

Toner base particles were obtained in the same manner as in Example 1 except that the crystalline polyester resin B was replaced by a crystalline polyester resin D. The crystalline polyester resin D had a dispersion diameter of 600 nm (average particle diameter: C-PES dispersion diameter), and the monoester-based wax E had a dispersion diameter of 500 nm (average particle diameter). The difference in SP value—Δ SP value—was 2.3 $(cal/cm^3)^{1/2}$.

Comparative Example 2

Toner base particles were obtained in the same manner as in Example 1 except that the monoester-based wax E was replaced by a monoester-based wax H (manufactured by NOF Corporation, WEP-2, melting point of 60° C.). The crystalline polyester resin B had a dispersion diameter of 200 nm (average particle diameter: C-PES dispersion diameter), and the monoester-based wax H had a dispersion diameter of 1,100 nm (average particle diameter). The difference in SP value—Δ SP value—was 1.5 $(cal/cm^3)^{1/2}$.

Comparative Example 3

Toner base particles were obtained in the same manner as in Comparative Example 2 except that the crystalline polyester resin B was replaced by a crystalline polyester resin D. The crystalline polyester resin D had a dispersion diameter of 600 nm (average particle diameter: C-PES dispersion diameter), and the monoester-based wax H had a dispersion diameter of 1,100 nm (average particle diameter). The difference in SP value—Δ SP value—was 2.3 $(cal/cm^3)^{1/2}$.

Comparative Example 4

Toner base particles were obtained in the same manner as in Example 1 except that the monoester-based wax E was replaced by a diester wax I (manufactured by NOF Corporation, WEP-8, melting point of 79° C.). The crystalline polyester resin B had a dispersion diameter of 200 nm (average particle diameter: C-PES dispersion diameter), and the diester wax I had a dispersion diameter of 150 nm (average particle diameter). The difference in SP value—Δ SP value—was 1.5 $(cal/cm^3)^{1/2}$.

Comparative Example 5

Toner base particles were obtained in the same manner as in Example 1 except that the monoester-based wax B was replaced by a hydrocarbon-based wax I (manufactured by Nippon Seiro Co., Ltd., FNP-90, melting point of 90° C.). The crystalline polyester resin B had a dispersion diameter of 200 nm (average particle diameter: C-PES dispersion diameter), and the hydrocarbon-based wax I had a dispersion diameter of 1,100 nm (average particle diameter). The difference in SP value—Δ SP value—was 1.5 $(cal/cm^3)^{1/2}$.

Physical properties of the toner base particles obtained in Examples 1 to 5 and Comparative Examples 1 to 5 will be shown in Table 1.

Two-component developers were prepared as follows by use of the toner base particles of Examples 1 to 5 and Comparative Examples 1 to 5.

Preparation of Two-Component Developers

Each of the toners (toner base particles) of 100 parts by weight obtained in Examples 1 to 5 and Comparative Examples 1 to 5 was mixed with 0.7 parts by weight of silica particles having 20 nm of an average primary particle diameter—subjected to a hydrophobizing treatment by use of a silane coupling agent—and 1 part by weight of titanium oxide so as to obtain an external toner. The obtained external toner was then mixed with ferrite core carriers having 40 μm of a volume average particle diameter in such a way that a concentration of the external toner comes to 7% with respect to a total amount of a two-component developer, resulting in the two-component developers having the toner concentration of 7%.

In Table 1, evaluation results, as listed below, of the toner base particles (obtained in the Examples and the Comparative Examples each) are shown—millability during the preparation process; fixability (baking phenomenon) at a time of image formation by use of the two-component developers each; and heat storage stability—as well as comprehensive evaluations.

The physical properties of the toner base particles—the millability during the toner preparation, the fixability by use of the two-component developers each, and the heat storage stability—were evaluated as below, and the comprehensive evaluations were given as well.

Evaluation Method of Baking Phenomenon

A developing unit and a toner cartridge of a color copying machine (trade name: MX-2640, manufactured by Sharp Corporation) were filled with the prepared two-component developer and the toner; and continuous print tests were carried out by use of 50,000 sheets of paper in an environment at 30° C. and at 80% humidity in such a way that a square-shaped solid image (ID=1.45 to 1.50), 1 cm on each side, comes to be formed at a position with three points—a central part and both ends in an axis direction of a developing roller.

Evaluation standards of the baking phenomenon are as follows.

B: Good. There is no decrease in concentration from an initial printed image through an image on the 50,000th sheet, and no fusion of the toner is found on a surface of the developing roller.

C: Somewhat poor. There is no decrease in concentration from an initial printed image through an image on the 50,000th sheet; however, some fusion of the toner is found on a surface of the developing roller.

D: Poor. There is a decrease in concentration from an initial printed image through an image on the 50,000th sheet, and some fusion of the toner is found on a surface of the developing roller.

Heat Storage Stability

The preservation stability was evaluated by the presence or absence of an aggregation substance in the toner after the toner was stored at a high temperature. 20 g of the toner was placed in a sealed plastic container and left at 50° C. for 72 hours, and the toner was then taken out of the container and was sifted through a 230-mesh sieve. The toner left on the sieve was measured for its weight, and a remained amount of the toner weight—a proportion of the remained toner with respect to its total weight—was obtained so as to evaluate it on the basis of the following evaluation standards. The lower remained amount means that the toner does not cause any blocking and that the toner base particles are fully covered with the covering layer.

The following are the evaluation standards.

A: Very good (There is no aggregation. The remained amount is less than 0.5%.)

B: Good (An extremely small amount of aggregation is found. The remained amount is 0.5% or more and less than 2%.)

C: Somewhat poor (A small amount of aggregation is found. The remained amount is 2% or more and less than 10%.)

D: Poor (A large amount of aggregation is found. The remained amount is 10% or more.)

Comprehensive Evaluations

The comprehensive evaluations were carried out as follows on the basis of the baking phenomenon and the preservation stability.

A: Very good (The both results are evaluated as A.)

B: Good (The one of the two results is evaluated as A, and the other is evaluated as B.)

C: Somewhat poor (The one of the two results is evaluated as C or higher than C.)

D: Poor (The one of the two results is evaluated as D.)

TABLE 1

| | Wax properties | | | Toner properties | | | | | |
|---|---|---|---|---|---|---|---|---|---|
| | | | | C-PES | Monoester-based Wax | Δ SP value | | | |
| | Wax | Melting point ° C. | Crystalline polyester resin | dispersion diameter (nm) | dispersion diameter (nm) | between resins $(cal/cm^3)^{1/2}$ | Baking phenomenon | Heat storage stability | Comprehensive evaluations |
| Ex 1 | Monoester-based wax E (WEP-3) | 73 | Crystalline polyester B | 200 | 500 | 1.5 | A | A | A |
| Ex 2 | Monoester-based wax E | 73 | Crystalline polyester C | 100 | 500 | 1.3 | A | B | B |
| Ex 3 | Monoester-based wax F (N-252) | 75 | Crystalline polyester B | 200 | 700 | 1.5 | B | A | B |
| Ex 4 | Monoester-based wax F | 75 | Crystalline polyester C | 100 | 700 | 1.3 | B | B | B |
| Ex 5 | Monoester-based wax G (N-272) | 68 | Crystalline polyester B | 200 | 500 | 1.5 | B | B | B |
| Comp Ex 1 | Monoester-based wax E | 73 | Crystalline polyester D | 600 | 500 | 2.3 | C | B | C |
| Comp Ex 2 | Monoester-based wax H (WEP-2) | 60 | Crystalline polyester B | 200 | 1100 | 1.5 | C | C | C |
| Comp Ex 3 | Monoester-based wax H (WEP-2) | 60 | Crystalline polyester D | 600 | 1100 | 2.3 | D | B | D |
| Comp Ex 4 | Diester-based wax I (WEP-8) | 79 | Crystalline polyester B | 200 | 150 | 1.5 | C | D | D |
| Comp Ex 5 | Hydrocarbon wax J | 90 | Crystalline polyester B | 200 | 1100 | 1.5 | D | B | D |

In view of the results of Examples 1 to 5 and Comparative Examples 1 to 5 shown in Table above, in the toners the C-PES had a dispersion diameter of 50 to 300 nm and the monoester-based wax had a dispersion diameter of 400 to 800 nm brought about the good results of the baking phenomenon and the heat storage stability as well as the comprehensive evaluations.

INDUSTRIAL APPLICABILITY

The present invention is capable of providing the two-component developer having the following features: The toner does not fuse with the developing roller surface even after being stirred in the two-component development apparatus for a prolonged time; the baking phenomenon does not occur, in which the entire developing roller surface is covered with the toner components as time passes; and the toner does not give rise to a decrease in image density.

What is claims is:

1. A toner comprising:

a crystalline polyester resin dispersed in an amorphous polyester resin obtained by polymerizing a bivalent alcohol component and a dicarboxylic component, the crystalline polyester resin containing a linear saturated aliphatic polyester unit and being dispersed by a monoester-based wax added as a detaching agent; wherein the crystalline polyester resin in the toner has a dispersion diameter of 100 nm or more and 500 nm or less;

the monoester-based wax has a dispersion diameter of 200 nm or more and 1,000 nm or less; and the toner is finely milled toner having a diameter of 6.7 μm or less.

2. The toner according to claim 1 wherein the crystalline polyester resin-to-the amorphous polyester resin in mass ratio is 5:95 to 50:50.

3. The toner according to claim 1 wherein a difference in solubility parameter value (Δ SP value) between the crystalline polyester resin and the amorphous polyester resin is 1.4 to 2.2 $(cal/cm^3)^{1/2}$.

4. The toner according to claim 1 wherein the crystalline polyester resin has a dispersion diameter of 100 nm or more to 300 nm or less, and the monoester-based wax has a dispersion diameter of 200 nm or more to 800 nm or less.

5. The toner according to claim 1 wherein the monoester-based wax has a melting point of 68° C. or higher to lower than 75° C.

* * * * *